US005771828A

United States Patent [19]

Arnold

[11] Patent Number: 5,771,828

[45] Date of Patent: Jun. 30, 1998

[54] SEWING OR EMBROIDERING MACHINE WITH A THREAD-CUTTING DEVICE

[75] Inventor: Kurt Arnold, Kaiserslautern, Germany

[73] Assignee: G.M. Pfaff Aktiengesellschaft, Kaiserslautern, Germany

[21] Appl. No.: 847,835

[22] Filed: Apr. 17, 1997

[30] Foreign Application Priority Data

Apr. 18, 1996 [DE] Germany ..... 196 15 308.5

[51] Int. Cl.[6] ..... D05B 19/00; D05B 65/00

[52] U.S. Cl. ..... 112/470.01; 112/300

[58] Field of Search ..... 112/470.01, 300, 112/220, 296, 298, 297, 163, 78, 102.5, 98

[56] References Cited

U.S. PATENT DOCUMENTS

| | | | |
|---|---|---|---|
| 3,359,933 | 12/1967 | Bono | 112/300 |
| 5,133,272 | 7/1992 | Hayashi | 112/300 X |
| 5,474,001 | 12/1995 | Tajima et al. | 112/102.5 |

FOREIGN PATENT DOCUMENTS

| | | |
|---|---|---|
| 19 68 920 | 9/1967 | Germany . |
| 1 485 255 | 6/1969 | Germany . |

*Primary Examiner*—Peter Nerbun
*Attorney, Agent, or Firm*—McGlew and Tuttle

[57] ABSTRACT

A sewing or embroidering machine is provided with a thread-cutting device and a signal transmitter representing the angular position of the arm shaft. The drive of the catch thread device is acted upon as a function of the signals generated by the signal transmitter according to a movement program stored in a memory. The path data of this movement program are in a defined relation to the rotary movement or the current angular position of the hook. The drive of the catch thread device is part of a regulating device operating as a cascade control or of a control device operating as a path plan control. Due to the exact agreement in time between the movement process of the catch thread device and the course of the rotary movement of the hook, the thread-cutting process can now also be carried out during the phase of deceleration of the sewing machine, so that an inexpensive, uncontrolled motor can now be used to drive the sewing machine.

12 Claims, 2 Drawing Sheets

2
3
S
8
9
11
13
10
4
12
14
15
26
16
17
27
25
20
19
24
23
21
22
1
6
5
7

2
3
S
8
9
11
13
10
4
12
30
31
32
33
36
34
35
1
6
5
7 n
$n_N$
$n_G$
$t_F$
t

S(α)
$\alpha_{St}$
α

SEWING OR EMBROIDERING MACHINE WITH A THREAD-CUTTING DEVICE

FIELD OF THE INVENTION

The present invention pertains to a sewing or embroidering machine with a motor for driving the stitch-forming tools, which comprise at least one needle bar and a hook cooperating with the needles of the needle bar, with a signal transmitter coupled with a machine shaft and with a thread-cutting device, which has a catch thread device movable relative to the hook and a drive associated with the catch thread device.

BACKGROUND OF THE INVENTION

The drive of prior-art thread-cutting devices comprises either a cam connected to the drive mechanism of the sewing machine in such a way that it rotates with it in unison, or a separate drive, e.g., in the form of an electromagnet or a compressed air cylinder.

In a thread-cutting device with cam drive, as it has been known from, e.g., DEOS 14 85 255, the cam used to perform the movement of the catch thread device is always in a synchronous relation with the drive mechanism of the sewing machine, so that the movement of the catch thread device always takes place in the same agreement in time with the rotary movement of the hook, which is set by the shape of the cam. Since the scanning member, which is associated with the cam and is connected to the driving linkage of the catch thread device, must be brought from the resting position into the working position by means of a signal-controlled electromagnet or a compressed air cylinder to initiate a thread-cutting process, the mechanical drive principle synchronized with the mechanism of the sewing machine requires a relatively great design effort.

In contrast, thread-cutting devices with a nonmechanical, separate drive have a markedly smaller number of components. One example of this is DE-GM 19 68 920, in which the drive of the cutting device consists of only an electromagnet and a two-armed lever, which is connected to the catch thread device via a rotary sliding joint. Since there is no positive-locking synchronization of the movement of the catch thread device with the rotary movement of the hook in this drive principle, the accurate mutual agreement in time between these two movement processes, which is necessary for the satisfactory result of thread catching, is achieved by the sewing machine being driven once again by half of one revolution of the arm shaft by means of a servo drive after stopping in the low position of the needle, and the hook performs a full revolution with essentially constant speed characteristic in the course of this half revolution. After the introduction of the speed-controlled positioning drives, it was possible to perform the thread cutting after decelerating the sewing machine to the so-called cutting speed, i.e., without first stopping the machine. However, this requires that the cutting speed be maintained highly accurately, because an exact agreement in time between the movement processes of the catch thread device and the hook is guaranteed in this case only. However, speed-controlled drive motors extensively insensitive to interfering effects are relatively expensive.

SUMMARY AND OBJECTS OF THE INVENTION

The primary object of the present invention is to create a thread-cutting device for a sewing or embroidering machine, in which thread-cutting device an accurate agreement in time between the movement process of the catch thread device and the rotary movement of the hook is guaranteed at a relatively low effort.

According to the invention, a sewing or embroidering machine is provided with a motor for driving the stitch-forming tools. The tools comprise at least one needle bar and a hook cooperating with the needles of the said needle bar. A signal transmitter is coupled with a machine shaft and with a thread-cutting device. The thread cutting device has a catch thread device movable relative to the hook and a drive associated with the said catch thread device. The drive of the catch thread device can be acted upon as a function of the signals generated by said signal transmitter according to a movement program stored in a memory. The path data of the movement program are in a certain (known or preestablished) relation to the rotary movement of the hook.

By driving the catch thread device by means of a movement program stored in a memory, wherein the position data of the program, which determine the actual instantaneous position of the catch thread device are in a fixed relation to the position signals generated by the signal transmitter and consequently also in relation to the actual rotary position of the hook, an accurate agreement in time between the movement process of the catch thread device and the course of the rotary movement of the hook is achieved, independently from the current speed of the sewing machine. It is thus possible to perform the thread-cutting process even during the phase of deceleration of the sewing machine, i.e., with the speed decreasing continuously, and it is still guaranteed that the catch thread device always penetrates exactly at the correct time into the thread triangle formed by the hook from the two legs of the needle thread loop and the hook thread and it separates the threads or thread parts to be cut off from the thread part that is not to be cut off.

Since a relatively inexpensive, uncontrolled motor, e.g., an asynchronous motor, can be used instead of an expensive, speed-controlled positioning motor in the case of such a functional behavior of the thread-cutting device, the overall effort is thus smaller despite the effort needed for embodying a program-controlled drive for the catch thread device. An additional advantage is the saving of time, which is achieved due to the fact that the thread-cutting process can be performed during the phase of deceleration of the sewing machine, without the need to interrupt this phase.

Since not only the agreement in time between the movement process of the catch thread device and the rotary movement of the hook, but also the absolute path of the catch thread device are established in terms of data by means of the movement program stored in the memory, the additional advantage is achieved that neither the drive nor any components of the thread-cutting device are moved against path-limiting stops, as a result of which the device according to the present invention operates especially silently.

Especially reliable functioning of the thread-cutting device is achieved due to the another feature according to the invention, according to which the drive of the catch thread device is part of a control device, which compares the actual position of the thread catch device with its desired position and seeks to eliminate variance when it occurs between the set point and the actual value. This means that a delay in the movement of the catch thread device compared with its desired movement, which may be caused by, e.g., a disturbance, is compensated, and the desired agreement in time between the movement process of the catch thread device and the rotary movement of the hook is again automatically established.

An especially simple embodiment of the drive concept according to the present invention is achieved by the use of an electromagnet as the drive of the catch thread device, with which a restoring spring may be associated. The current fed to the electromagnet represents the correcting variable of the control device here.

If especially strong forces are to be applied for cutting through thick and strong threads, it could be useful to use a reversing lifting magnet as the drive for the catch thread device.

Due to the use of the drive of the catch thread device as an adjusting member of a program control, a simplified alternative variant of the invention is obtained. A stepping motor may also be used as a preferred drive element. If the occurrence of excessively strong interfering forces, which could bring the drive or the stepping motor out of step, during the operation of the thread-cutting device can be ruled out, it is guaranteed that the movement process of the catch thread device is always accurately coordinated with the course of the rotary movement of the hook according to the program even if a driving device designed as a path plan control is used.

The actually corresponding movement program for the catch thread device can be associated with a thread-cutting device, depending on the intended use, due to the replaceability of the memory, while the basic control engineering design of the driving device can be standardized for all possible applications.

The measure according to a further feature of the invention by which the memory has different, individually selectable movement programs, makes it possible to provide a time and/or path-optimized movement program for thread catching in the left or right overstitch position, e.g., in zigzag sewing machines. Depending on which of the two overstitch positions the thread-cutting device is triggered in, the respective corresponding movement program is selected automatically.

Due to a further aspect of the invention, according to which the correcting variable is variable, a higher gain factor can be set for energizing the electromagnet when an electromagnet is used to cut strong, resistant threads.

The present invention will be explained on the basis of two exemplary embodiments shown in the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
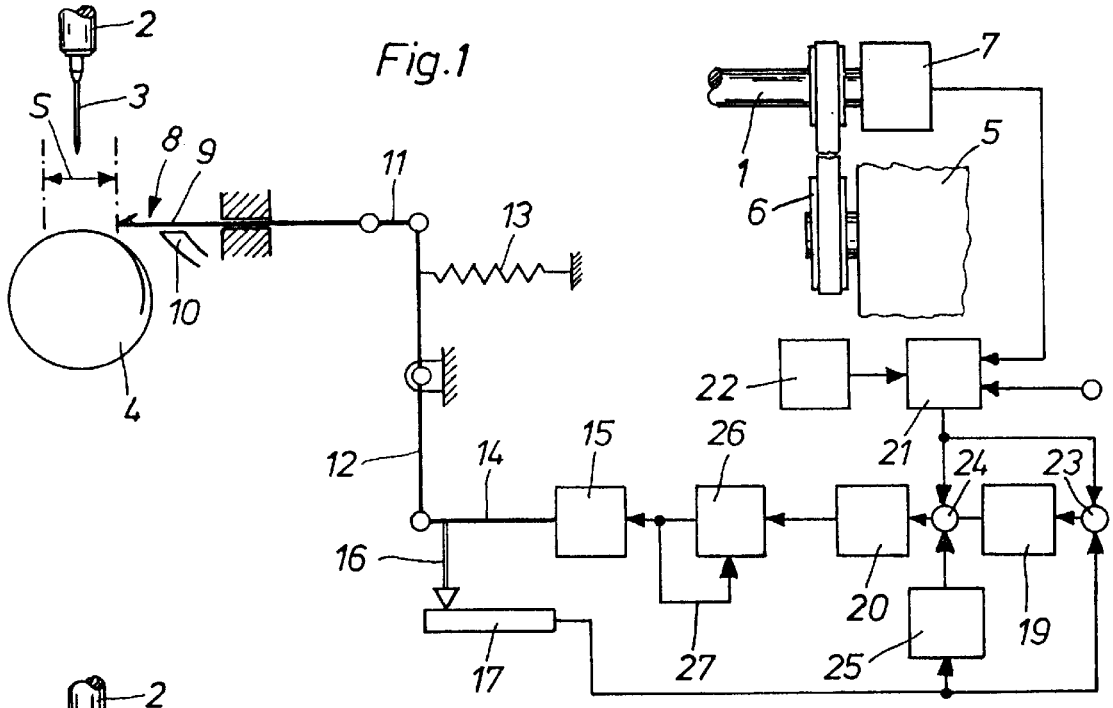
FIG. 1 is a schematic representation of the thread-cutting device, in which the drive of the catch thread device is connected to a regulating device.

Referring to the drawings in particular, only part of the arm shaft 1, part of the needle bar 2 driven via the arm shaft 1, the needle 3 inserted in the said needle bar, as well as the hook 4 cooperating with the needle to form double thread lockstitches, are shown of the sewing machine, which is shown in a highly schematic form only. An asynchronous motor 5, which is in drive connection with the arm shaft 1 via a belt drive 6, is used to drive the sewing machine. A signal transmitter 7 scanning the angular position $\alpha$ of the arm shaft 1 is connected to the arm shaft 1.

The sewing machine contains a thread-cutting device 8, which has a horizontally movable catch thread device 9 and a stationarily arranged cutting knife 10. The shape of the catch thread device 9 corresponds to that of the catch thread device disclosed in the above-mentioned DE-GM 19 68 920. The catch thread device 9 correspondingly also has a tip, which is not shown in detail here, a hook, and a cutting edge, which cooperates with the cutting knife 10. The catch thread device 9 is connected via a connecting rod 11 to a two-armed lever 12, which is held in a starting position by means of a tension spring 13.

In the exemplary embodiment according to FIG. 1, the tie rod 14 of an electromagnet 15 is articulated to the lever 12. The wiper arm 16 of a displacement transducer 17 is fastened to the tie rod 14.

A regulating device operating as a cascade control is used to operate the electromagnet 15. This cascade control comprises essentially two controllers connected to one another in a cascade structure, namely, a position controller 19 and a velocity controller 20. The regulating device also contains a set point transducer 21. A first input of the set point transducer 21 is connected to the signal transmitter 7, and a second input is connected to the machine control, not shown, from which a start signal is sent for initiating a thread-cutting process. A first output of the set point transducer 21 is connected to a comparator point 23 associated with the position controller 19, and a second output is connected to a comparator point 24 associated with the velocity controller 20.

The comparator point 23 is directly connected to the displacement transducer 17 and receives from it measured signals, which indicate the current position of the tie rod 14. Since this tie rod 14 is in positive-locking connection with the catch thread device 9 via the lever 12 and the connecting rod 11, the displacement signals also indicate indirectly the current position of the catch thread device 9. The comparator point 24 is indirectly connected to the displacement transducer 17 via a differentiating member 25. The current velocity ds/dt of the tie rod 14 and of the catch thread device 9 is calculated in the differentiating member 25 and is sent to the comparator point 24.

The output signals of the velocity controller 20 are sent to an output stage 26, where they are amplified to operate the electromagnet 15. The current intensity in the feed line leading to the electromagnet 15 can be monitored by means of a feedback branch 27. Optimal control properties can thus be achieved, and excessively high current intensities can thus be avoided.

Figure 2:
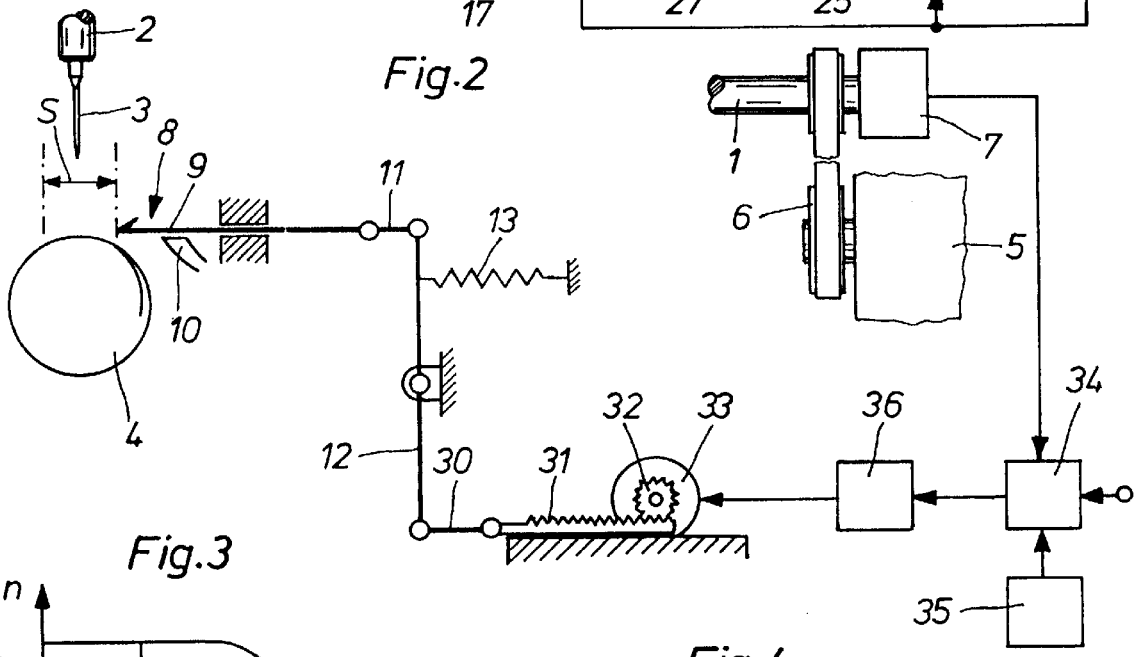
FIG. 2 is a schematic representation of the thread-cutting device, in which the drive of the catch thread device is connected to a control device.

A connecting rod 30, which is connected to a rack 31, is articulated to the lever 12 in the exemplary embodiment according to FIG. 2. A pinion 32, which is fastened to the shaft of a stepping motor 33, meshes with the rack 31.

A control device 34, designed as a path plan control, is used to operate the stepping motor 33. A memory 35 used as a program transmitter is associated with the control device 34. The control device 34 is connected via additional inputs to the signal transmitter 7 and to the machine control, not shown, from which a start signal for initiating a thread-cutting process is sent. The output signals of the control device 34 are sent to an output stage 36, where they are transformed into drive signals for the stepping motor 33.

Figure 3:
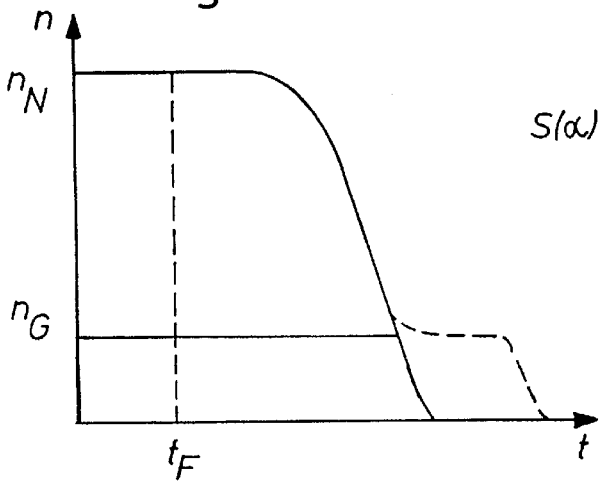
FIG. 3 is a diagram showing the course of the machine speed n over time t.
Figure 4:
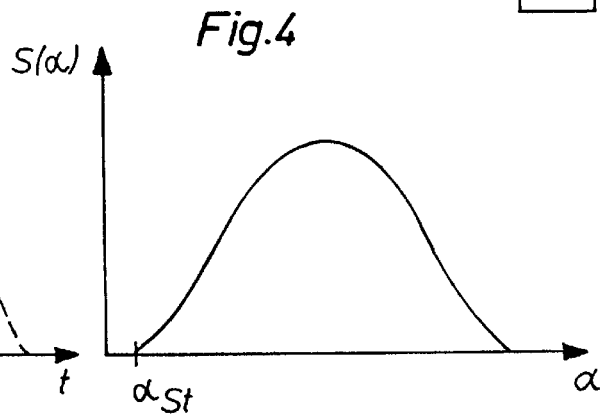
FIG. 4 is a diagram showing the course of the path S traveled by the catch thread device over the angle of rotation $\alpha$.
Figure 5:
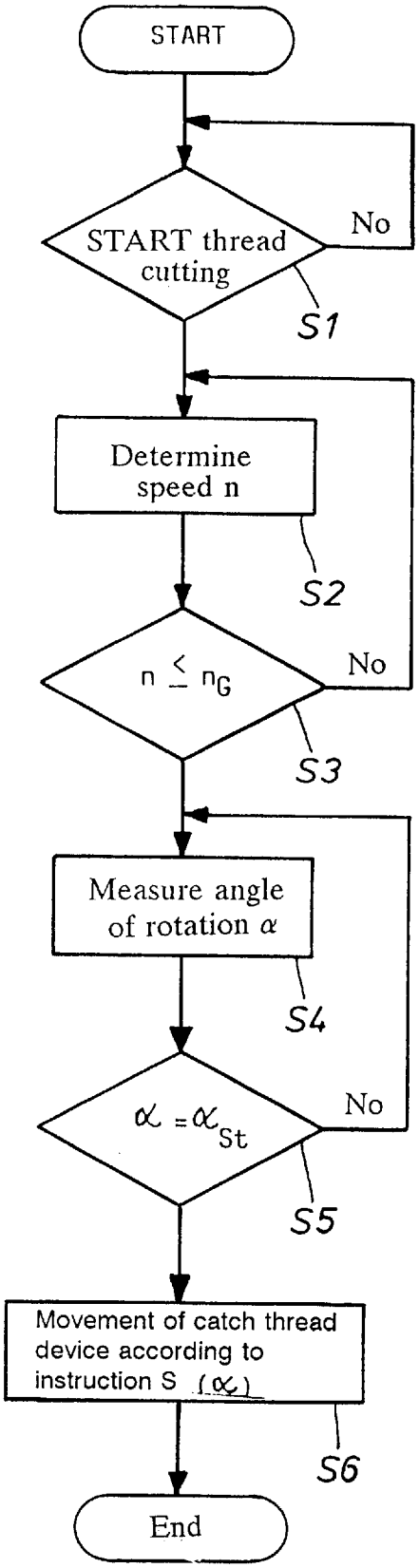
FIG. 5 is a flow chart of the operation process after the start signal for thread cutting has been sent.

The mode of operation of the thread-cutting device will be described below on the basis of the flow chart in FIG. 5 and of the diagrams in FIGS. 3 and 4.

After the sewing machine has been started, the command is given for performing a thread-cutting process at a point in time $t_F$ set by the operator, e.g., at the end of a seam or of a seam section, in step S1. The sewing machine is still operating at full speed $n_N$ at this point in time. The machine or motor control now decelerates the sewing machine to a stop, while making a few more stitches, and the speed n of the sewing machine or of the arm shaft 1 is described by the curve drawn in solid line in the diagram in FIG. 3.

The speed n of the arm shaft 1 is determined in step S2. A check is performed at the branching in step S3 to determine whether the current speed n is lower than or equal to a limit speed $n_G$, which essentially corresponds to the cutting speed in sewing machines with speed-controlled positioning drive. This limit speed of revolutions $n_G$, set at, e.g., 180 rpm, is measured so that upon reaching this speed of revolutions the machine performs at least two more complete revolutions of the hook until the machine stops.

When the limit speed $n_G$ is reached, the angle of rotation $\alpha$ of the arm shaft 1 is measured in step S4 via the signal transmitter 7. As soon as an angle of rotation $\alpha_{St}$, which is intended for the proper performance of a thread-cutting process and which is used as a starting point, has been determined, the movement of the catch thread device 9 is then performed in step S6 according to an instruction S ($\alpha$) stored in the memory 22 or 35. The instruction S ($\alpha$) states that a movement program, whose position data, which determine the path S of the catch thread device 9, are in a fixed relation according to FIG. 4 to the actual angle of rotation $\alpha$ of the arm shaft 1 or to the angle data of the arm shaft 1 generated by the signal transmitter 7, is stored in the memories 22 and 35 for the drive of the catch thread device 9.

While the above-described operating process according to steps S1 through S5 is equally valid for the thread-cutting device designed as a regulating device and as a control, the instruction S ($\alpha$) is now processed in the different thread-cutting devices corresponding to their particular design.

In the device according to FIG. 1, the movement program being stored in the memory 22 is calculated by the set value transducer 21 into corresponding anticipatory control values for the positioning controller 19 and the velocity controller 20 and they are sent to the comparator points 23, 24. The output variable sent by the positioning controller 19 is sent to the velocity controller 20 via the comparator point 24, as a result of which the velocity controller 20 generates a velocity-proportional control signal. This is amplified in the output stage to the extent that the electromagnet 15 acting as an adjusting member is operated according to the program. The electromagnet 15 first attracts the tie rod 14, pivoting the lever 12 in the process, and, as a consequence of this, it displaces the catch thread device 9 from the starting position shown into the end position predetermined by the movement program, while it penetrates with its tip into the triangle (not shown) formed by the two legs of the needle thread loop and the hook thread. The spring 13 then pulls the catch thread device 9 back into the starting position, while the threads or thread parts to be cut are grasped by the hook in the known manner and are cut through near the end of the movement of the catch thread device in cooperation between the cutting edge and the cutting knife 10.

Since the position data for the movement of the catch thread device are permanently associated with certain angles $\alpha$ of the arm shaft 1 in the movement program for the catch thread device 9, the set point transducer 21 sends feed data synchronized with the current rotary movement of the arm shaft 1 for the movement of the catch thread device 9, so that the latter is always driven exactly coordinated with the rotary movement of the arm shaft 1 and consequently of the hook 4.

The path actually traveled by the catch thread device 9 is determined by the displacement transducer 17 while the thread-cutting process is being performed and it is sent as a signal sequence to the comparator point 23, where a possible variance between the set point and the actual value of the movement of the catch thread device is determined. If a variance is present, it is compensated by the positioning controller 19 in the known manner.

Furthermore, the signal values of the displacement transducer 17 are continuously calculated in the differentiating member 25 into a velocity actual value ds/dt and compared at the comparator point 24 with a position-related velocity set point. If a variance is present, it is compensated by the velocity controller 20 in the known manner.

In the device according to FIG. 2, the movement program being stored in the memory 35 is calculated by the control device 34 into corresponding control values, which are amplified in the output stage 36 into driving signals for the stepping motor 33. The stepping motor 33 now drives the lever 12 via the pinion 32, the rack 31 and the connecting rod 30 comparably to the electromagnet 15 of the first exemplary embodiment, and the catch thread device 9 is also moved according to the instruction S ($\alpha$), almost exactly coordinated with the rotary movement of the arm shaft 1 and consequently of the hook 4.

Since the movement of the catch thread device 9 is always coupled with the rotary movement of the arm shaft 1 according to the program in both design variants, the catch thread device 9 always performs movements coordinated with the rotary movement of the hook 4 according to the instruction S ($\alpha$), doing so independently from the current speed of the sewing machine. This means that the thread-cutting process can be performed during the phase of deceleration of the sewing machine and consequently while the speed is continuously decreasing according to the solid line in the diagram shown in FIG. 3. It is therefore unnecessary in this case to provide a section with constant cutting speed according to the broken line in the diagram shown in FIG. 3 during the phase of deceleration for carrying out the thread cutting, as it was necessary before for the operation of thread-cutting devices in sewing machines with speed-controlled positioning motors. A considerable amount of time is therefore saved in the thread-cutting device according to the present invention compared with the prior-art thread-cutting devices.

While specific embodiments of the invention have been shown and described in detail to illustrate the application of the principles of the invention, it will be understood that the invention may be embodied otherwise without departing from such principles.

What is claimed is:

1. A sewing or embroidering machine, comprising:

a motor for driving stitch-forming tools, which comprise at least one needle bar and a hook cooperating with a needle of the said needle bar;

a machine shaft;

a thread-cutting device including a catch thread device movable relative to the hook and a drive associated with said catch thread device;

signal transmitters coupled, respectively, with said machine shaft and with said thread-cutting device;

movement program means for acting on said drive of said catch thread device as a function of signals generated by said signal transmitters according to a movement program stored in a memory, said movement program having path data in a certain relation to a rotary movement of said hook.

2. The sewing or embroidering machine in accordance with claim 1, wherein said drive of said catch thread device is connected to a displacement transducer and is part, together with said catch thread device as well as said signal transmitters, forms a regulating device operating as a cascade control, wherein said movement program is stored in said memory and sends a command variable of said cascade control.

3. The sewing or embroidering machine in accordance with claim 2, wherein said drive of said catch thread device is formed by an electromagnet.

4. The sewing or embroidering machine in accordance with claim 3, wherein a restoring spring is associated with said electromagnet.

5. The sewing or embroidering machine in accordance with claim 3, wherein said electromagnet is a reversing lifting magnet.

6. The sewing or embroidering machine in accordance with claim 2, wherein said drive of said catch thread device is formed by one of a motor, a linear motor and a controlled pressurized medium cylinder.

7. The sewing or embroidering machine in accordance with claim 1, wherein said drive of said catch thread device is an adjusting member of a control device operating as a path plan control, wherein said movement program is stored in said memory and sends a command variable of said path plan control.

8. The sewing or embroidering machine in accordance with claim 7, wherein said drive is formed by a stepping motor.

9. The sewing or embroidering machine in accordance with claim 1, wherein said memory is replaceable.

10. The sewing or embroidering machine in accordance with claim 1, further comprising means for changing data in said memory.

11. The sewing or embroidering machine in accordance with claim 1 wherein said memory has different, individually selectable movement programs.

12. The sewing or embroidering machine in accordance with claim 1 wherein drive signals representing a correcting variable for the drive of the said catch thread device are variable.

* * * * *